US011787022B2

(12) United States Patent
Eriksson et al.

(10) Patent No.: US 11,787,022 B2
(45) Date of Patent: Oct. 17, 2023

(54) POWER SCREW DRIVER

(71) Applicant: ATLAS COPCO INDUSTRIAL TECHNIQUE AB, Stockholm (SE)

(72) Inventors: Ulf Mikael Eriksson, Vallentuna (SE); Karl Göran Johansson, Saltsjö-Boo (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 392 days.

(21) Appl. No.: 17/254,377

(22) PCT Filed: Jun. 25, 2019

(86) PCT No.: PCT/EP2019/066734
§ 371 (c)(1),
(2) Date: Dec. 21, 2020

(87) PCT Pub. No.: WO2020/002271
PCT Pub. Date: Jan. 2, 2020

(65) Prior Publication Data

US 2021/0268631 A1 Sep. 2, 2021

(30) Foreign Application Priority Data

Jun. 29, 2018 (SE) ..... 1830205-9

(51) Int. Cl.
*B25B 23/08* (2006.01)
*B25B 21/00* (2006.01)

(52) U.S. Cl.
CPC ..... *B25B 23/08* (2013.01); *B25B 21/00* (2013.01)

(58) Field of Classification Search
CPC ..... B25B 21/00; B25B 21/001; B25B 21/002; B25B 23/00; B25B 23/02; B25B 23/04;
(Continued)

(56) References Cited

U.S. PATENT DOCUMENTS 2,507,737 A 5/1950 Shaff
2,570,164 A 10/1951 Shaff
(Continued)

FOREIGN PATENT DOCUMENTS

CN 104493476 A 4/2015
EP 3230011 A1 10/2017
(Continued)

OTHER PUBLICATIONS

International Search Report (ISR) dated Nov. 4, 2019 issued in International Application No. PCT/EP2019/066734.
(Continued)

*Primary Examiner* — Robert J Scruggs
(74) *Attorney, Agent, or Firm* — Holtz, Holtz & Volek PC

(57) ABSTRACT

A power screwdriver includes a housing having a vacuum chamber arranged to communicate with a source of sub-atmospheric pressure. The power screwdriver includes a motor, a bit drive spindle, and a bit supporting sleeve connected to the bit drive spindle. The rear end part of the bit supporting sleeve is surrounded by the vacuum chamber. The bit supporting sleeve is journaled by a bearing between a forward end part and a rear end part of the bit supporting sleeve. The bit supporting sleeve includes at least one longitude vacuum passage extending from its rear end part to its forward end part.

8 Claims, 4 Drawing Sheets

(58) Field of Classification Search
CPC ..... B25B 23/08; B25B 23/10; B25B 23/145; B23P 19/06; B23P 19/069; A61B 17/8875
See application file for complete search history.

(56) References Cited

U.S. PATENT DOCUMENTS

| | | | | |
|---|---|---|---|---|
| 4,924,732 | A * | 5/1990 | Hoskins | B25B 21/00 81/451 |
| 7,930,955 | B2 | 4/2011 | Miyamoto | |
| 2021/0154812 | A1* | 5/2021 | Zander | B23P 19/06 |

FOREIGN PATENT DOCUMENTS

| | | | |
|---|---|---|---|
| JP | S48114197 | U | 12/1973 |
| WO | 2009110057 | A1 | 9/2009 |

OTHER PUBLICATIONS

Written Opinion dated Nov. 4, 2019 issued in International Application No. PCT/EP2019/066734.
U.S. Appl. No. 16/614,303; First Named Inventor: Johan ZANDER; Title: "Power Screw Driver With Screw Pick-Up Feature"; Filed: Nov. 15, 2019.
Japanese Office Action dated Mar. 23, 2023, issued in counterpart Japanese Application No. 2020-571363.

* cited by examiner

POWER SCREW DRIVER

TECHNICAL FIELD

The invention relates to a power screw driver. Specifically, the invention relates to a power screw driver arranged to be connected to a vacuum adapter.

BACKGROUND

In some applications in the use of power screw drivers the handling of fastener such as screws is particularly cumbersome. This is especially true for the handling of small screws. For these applications vacuum can be used.

The idea with vacuum adapter is to suck up the screw, screw head first, such that the screw head will be sucked into contact with the bit. Subsequently the power screw driver will be relocated such that the screw will be positioned at the hole into which it is to be screwed such that the tightening operation may be initiated.

In particular, the invention concerns a power screw driver having a vacuum activated screw pick-up functionality by which a screw to be mounted is brought into engagement with the bit in a pre-tightening sequence.

In prior art power screw drivers vacuum is often lead on the outside of the power screw driver to a vacuum adapter attached to the power screw driver. In other power screw drivers the housing including the vacuum chamber reaches a forwardly extended position of the power screw driver, where the vacuum chamber communicates directly to the bit surrounding suction nozzle.

This means that the relatively wide forward part of the housing easily abuts against structure parts surrounding the screw location thereby obstructing the bit from reaching the screw to be tightened. Accordingly, the housing and vacuum chamber arrangement of prior art screw drivers is disadvantageous as it creates a limitation as to the accessibility to narrow or cramped screw positions.

Another problem inherent in prior art power screw drivers with vacuum screw pick-up features is that the bit surrounding suction nozzle is rigidly attached to the housing via the vacuum chamber, which means that during tightening of a screw there will always be a relative rotation between the bit and the suction nozzle. This tends to make the screw wobble and easily loose its contact with the bit and eventually fall out, thereby causing an undesirable process interruption. In particular, this would happen if the screw head has got some geometrical irregularities. Relative rotation between the bit and the suction nozzle would also cause friction forces which tend to affect the quality of the tightening process.

Thus there is a need for an improved power screw driver, which can solve or at least mitigate the above mentioned problems.

SUMMARY

It is an object of the invention to provide an improved power screw driver where the vacuum is not lead on the outside of the power screw and without a wide forward part of the power screw driver.

This object is achieved in accordance with a first aspect of the disclosure by a power screw driver comprising a housing 10 having a vacuum chamber 31 arranged to communicate with a source of sub-atmospheric pressure. The power screw driver comprises a motor, a bit drive spindle 22, a bit supporting sleeve 26 connected to the bit drive spindle 22. Wherein the rear end part of the bit supporting sleeve 26 is surrounded by the vacuum chamber 31. The bit supporting sleeve 26 is journaled by a bearing 27 between a forward end part 26*a* and a rear end part 26*b* of the bit supporting sleeve 26. The bit supporting sleeve 26 comprises at least one longitude vacuum passage 28 extending from its rear end part 26*b* to its forward end part 26*a*.

BRIEF DESCRIPTION OF THE DRAWINGS

The invention will now be described in more detail and with reference to the accompanying drawings, in which.

DETAILED DESCRIPTION

Figure 1:
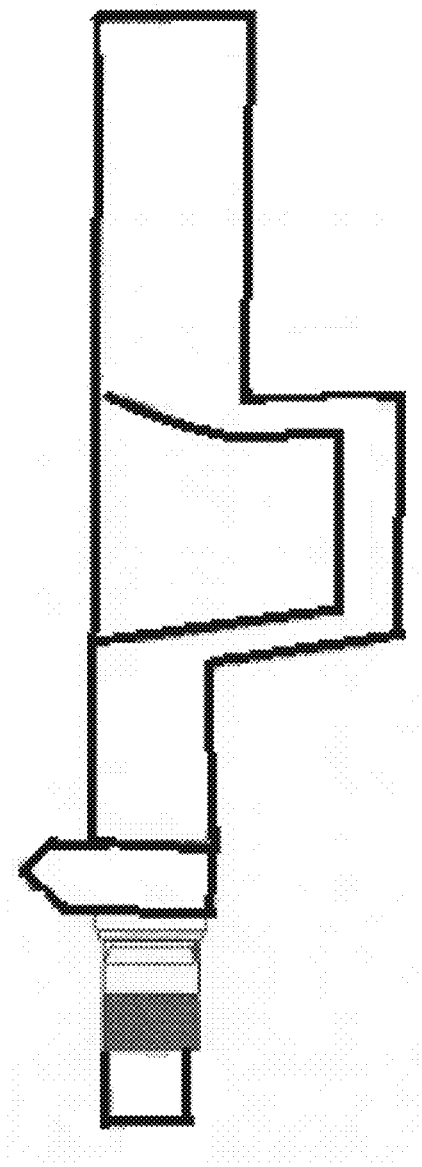
FIG. 1 shows a power screw driver according to prior art.

FIG. 1 illustrates a power screw driver according to prior art. As can be seen the housing has at its forward output end a vacuum activated screw pick-up device. The housing is also provided with a means for connecting the screw driver to a power supply and for connecting the screw pick-up device to a source of sub-atmospheric pressure. At its forward end the power screw driver carries a screw engaging bit surrounded by a suction nozzle for picking up and holding a screw to be mounted and tightened. As illustrated in FIG. 1, the housing of the prior art power screw driver extends to a position rather close to the output end of the screw engaging bit. This means that when tightening screws it is difficult to reach tight positions since the housing easily gets into contact with structure parts adjacent the intended screw position. Thus obstructing the screw driver from being used in such positions.

Figure 2:
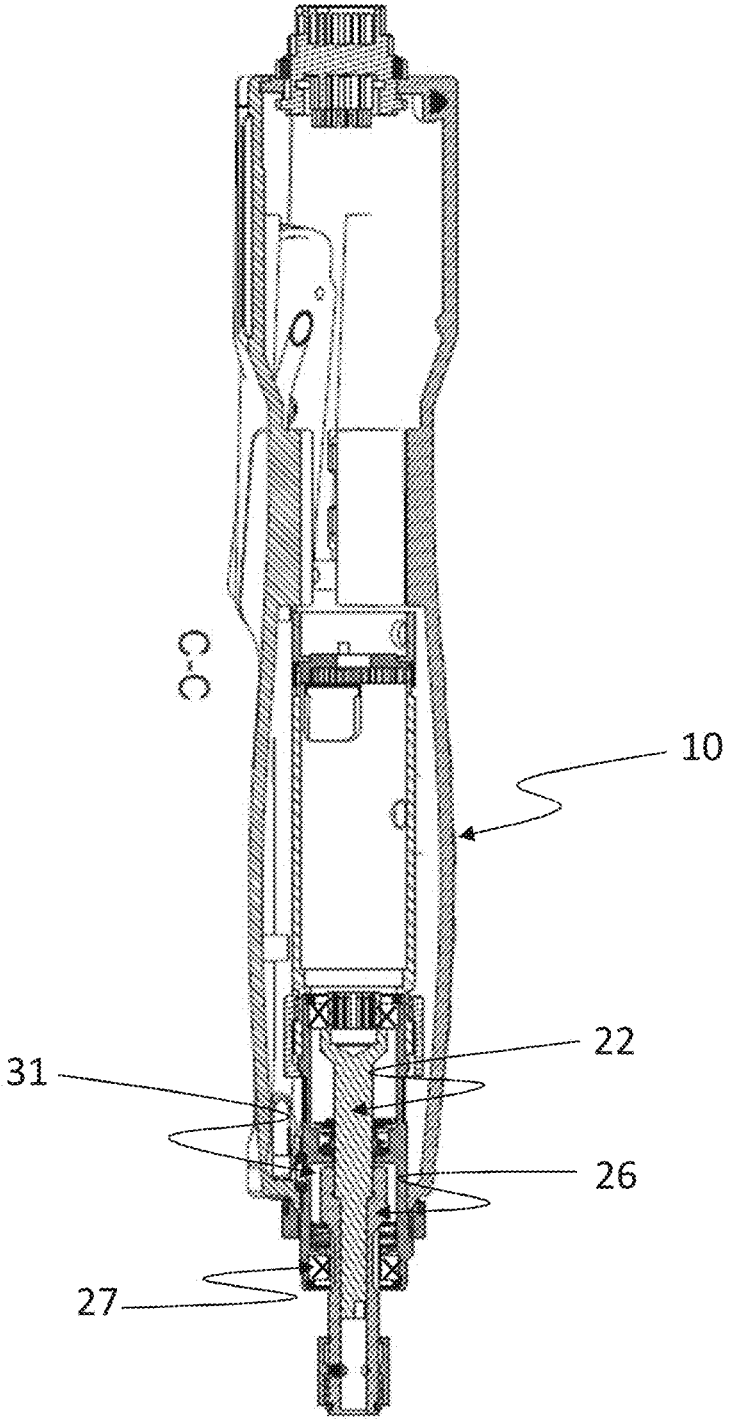
FIG. 2 shows a longitudinal section view of an exemplary embodiment of the power screw driver.

FIG. 2 illustrates an exemplary embodiment of a power screw driver 10 according to the present disclosure. As can be seen the power screw driver 10 according to the present disclosure has a slim design. The power screw driver 10 comprises a vacuum chamber 31, and a bit drive spindle 22 extending through the vacuum chamber 31. The bit drive spindle 22 is connectable to a screw engaging bit (not shown) via a for instance a half-moon coupling 25 for transferring a tightening torque to a screw being tightened. The power screw driver further comprises a bit supporting sleeve 26.

Figure 3:
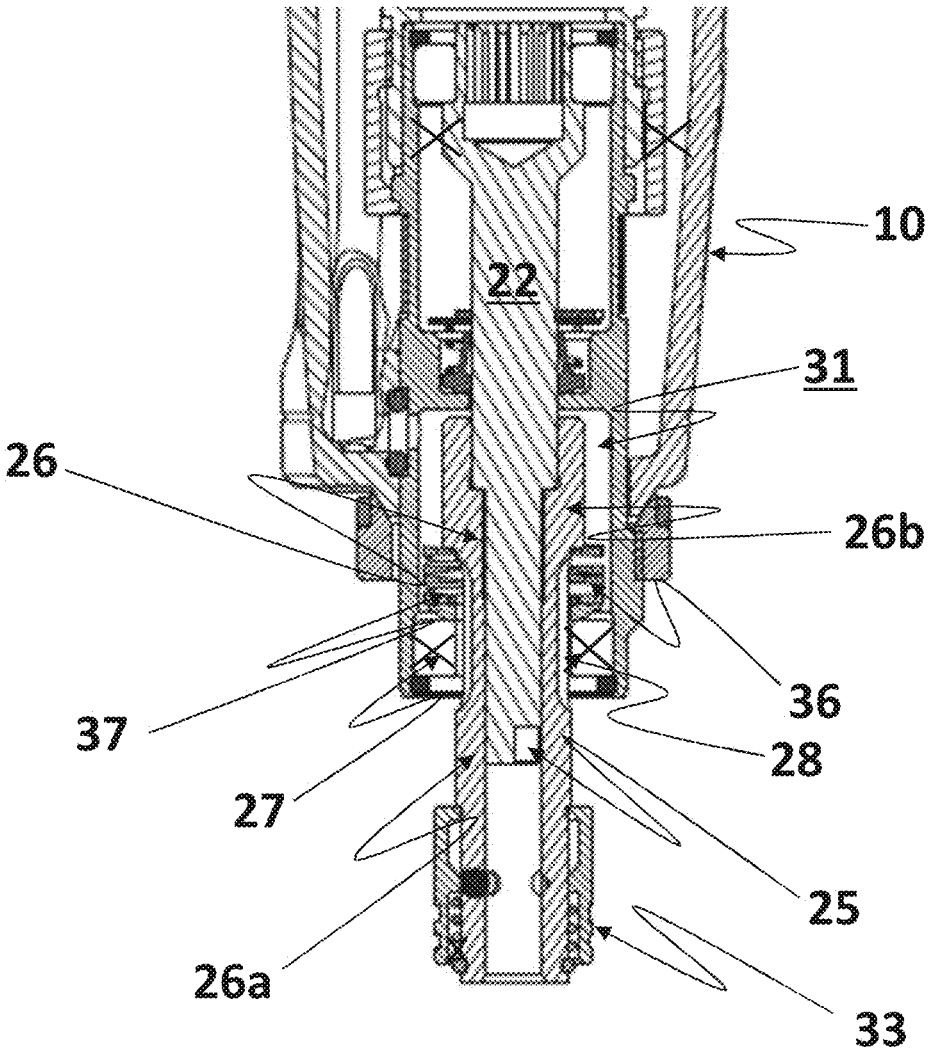
FIG. 3 shows a front end of an exemplary embodiment of the power screw driver 10.

FIG. 3 illustrates an exemplary embodiment of a front end of the power screw driver 10 according to the present disclosure.

In one exemplary embodiment the bit supporting sleeve 26 is rigidly secured to the drive spindle 22 via a press fit. The bit supporting sleeve is journaled with respect to the housing 10 via a bearing 27. The bit supporting sleeve 26 comprises a forward end part 26*a* and a rear end part 26*b*. The forward end part 26*a* surrounds the bit. The rear end part 26*b* of the bit supporting sleeve 26 is surrounded by a vacuum chamber 31 which is formed as a part of the housing 10 and which communicates with an external source of sub-atmospheric pressure.

Moreover, the bit supporting sleeve 26 comprises at least one longitude vacuum passage 28 extending from its rear end part 26*b* to its forward end part 26*a*. The at least one longitude vacuum passage 28 in the bit supporting sleeve 26 form a vacuum path from the forward end part 26*a* to an external source of sub-atmospheric pressure via the vacuum chamber 31.

By providing a vacuum path to the forward end part 26*a* via the at least one longitude vacuum passage 28 it has been possible to locate the arrangement (not shown) using the vacuum to fetch the screw at an axial distance from the vacuum chamber 31. Thus a forward end section of the housing 10 can be made slim.

This means that access to screws located in narrow and difficult to reach positions has been very much facilitated, because the screw driver is not obstructed by the housing interfering with structure parts adjacent such screw locations.

According to one exemplary embodiment, the at least one longitude vacuum passage 28 is a track in the surface of the bit supporting sleeve 26. In yet another exemplary embodiment of the power screw driver 10, the bit supporting sleeve 26 comprises several longitude vacuum passages. An advantage of having several longitude vacuum passages is that a better air flow can be achieved from the forward end part 26*a* to the rear end part 26*b* of the bit supporting sleeve 26.

In a further exemplary embodiment of the power screw driver 10, the several longitude vacuum passages 28 are symmetrically arranged on the bit supporting sleeve 26. By symmetrically arranging the several longitude vacuum passages 28 imbalance of the bit supporting sleeve 26 can be avoided.

In yet another exemplary embodiment of the power screw driver 10, the longitude vacuum passage 28 are rounded in the rear end part 26*b* and in the forward end part 26*a* of the bit supporting sleeve 26. The rounded shape of vacuum passage can be obtained by different processes. Milling with a spherical head can obtain a semi-spherical geometry at the end of the milling track creating the rounded end creating a smooth transition for the air flow. An advantage by the longitude vacuum passage 28 being rounded in the rear end part 26*b* and in the forward end part 26*a* is that turbulence is reduced.

Turbulence has a negative effect of reducing air flow through the longitude vacuum passage 28.

In a further exemplary embodiment of the power screw driver 10 the bearing 27 is arranged to not allow air to pass through the bearing 27. An advantage by the bearing 27 being air tight is better air flow through the longitude vacuum passage 28. In a further exemplary embodiment of the power screw driver 10 the bearing 27 is adjacent a front end of the power screw driver 10. According to one exemplary embodiment, the bit supporting sleeve is surrounded by a spring 37 on the rear end part 26*b*, wherein the spring forces the bit supporting sleeve 26 towards the bit drive spindle 22. In yet another exemplary embodiment the spring 37 pushes on a ring shaped element 36 surrounding the bit supporting sleeve 26, the ring shaped element 36 rests on an inner of the bearing 27 at the rear end part 26*b*.

Figure 4:
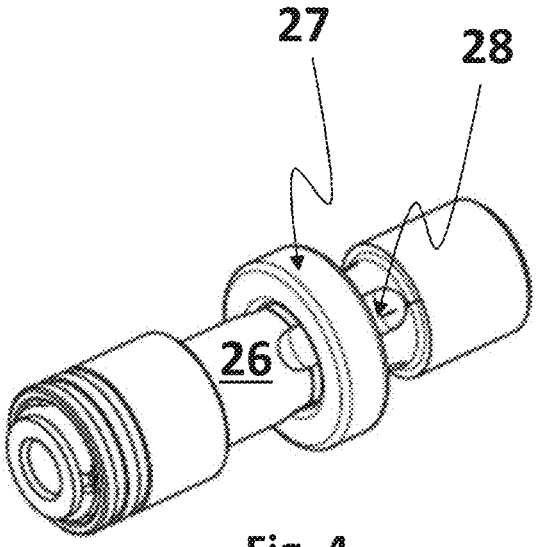
FIG. 4 shows an exemplary embodiment of a bit supporting sleeve.

FIG. 4 illustrates an exemplary embodiment of the bit supporting sleeve 26 and the bearing 27 in the power screw driver 10. As can be seen in FIG. 3, in this exemplary embodiment the bit supporting sleeve 26 comprises longitude vacuum passages 28 that are rounded in the rear end part 26*b* and in the forward end part 26*a* of the bit supporting sleeve 26. The longitude vacuum passages 28 are arranged as tracks in the surface of the bit supporting sleeve 26. Thus as can be seen from the figure on the inside of the bearing 27.

The invention claimed is:

1. A power screwdriver comprising:

a housing having a vacuum chamber arranged to communicate with a source of sub-atmospheric pressure;

a motor;

a bit drive spindle;

a bit supporting sleeve connected to the bit drive spindle, wherein a rear end part of the bit supporting sleeve is surrounded by the vacuum chamber; and a bearing journaling the bit supporting sleeve between a forward end part and the rear end part of the bit supporting sleeve, wherein the bit supporting sleeve comprises at least one longitude vacuum passage extending from the rear end part to the forward end part of the bit supporting sleeve, and wherein the at least one longitude vacuum passage is a track in an external surface of the bit supporting sleeve.

2. The power screwdriver according to claim 1, wherein the bit supporting sleeve comprises a plurality of longitude vacuum passages.

3. The power screwdriver according to claim 2, wherein the plurality of longitude vacuum passages are symmetrically arranged on the bit supporting sleeve.

4. The power screwdriver according to claim 1, wherein the longitude vacuum passage is rounded in the rear end part and in the forward end part of the bit supporting sleeve.

5. The power screwdriver according to claim 1, wherein the bearing is arranged to not allow air to pass through the bearing.

6. The power screwdriver according to claim 1, wherein the bearing is adjacent a front end of the power screwdriver.

7. The power screwdriver according to claim 6, wherein a spring pushes on a ring shaped element surrounding the bit supporting sleeve, and the ring shaped element rests on an inner side of the bearing.

8. The power screwdriver according to claim 1, wherein the bit supporting sleeve is surrounded by a spring on the rear end part, and wherein the spring forces the bit supporting sleeve towards the bit drive spindle.

* * * * *